US008543236B2

(12) United States Patent
Freson et al.

(10) Patent No.: US 8,543,236 B2
(45) Date of Patent: Sep. 24, 2013

(54) LENS BLOCKING METHOD AND RELATED DEVICE

(75) Inventors: David Freson, Charenton (FR); Yohann Felten, Charenton (FR); Pascal Thomas, Charenton (FR); Matthieu Le Gall, Charenton (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 647 days.

(21) Appl. No.: 12/668,688

(22) PCT Filed: Jul. 11, 2008

(86) PCT No.: PCT/EP2008/059095

§ 371 (c)(1),
(2), (4) Date: Jul. 12, 2010

(87) PCT Pub. No.: WO2009/010466

PCT Pub. Date: Jan. 22, 2009

(65) Prior Publication Data

US 2010/0297919 A1 Nov. 25, 2010

(30) Foreign Application Priority Data

Jul. 13, 2007 (EP) ..... 07290884
Jul. 16, 2007 (EP) ..... 07301237

(51) Int. Cl.
*G06F 19/00* (2011.01)

(52) U.S. Cl.
USPC ..... 700/192

(58) Field of Classification Search
USPC ..... 700/192, 197; 351/159.01; 451/5, 451/42, 384, 390
See application file for complete search history.

(56) References Cited

U.S. PATENT DOCUMENTS

| | | | | |
|---|---|---|---|---|
| 5,341,604 | A * | 8/1994 | Wood | 451/5 |
| 5,919,080 | A | 7/1999 | Savoie et al. | |
| 6,036,313 | A | 3/2000 | Benjamin et al. | |
| 2003/0214058 | A1 | 11/2003 | Belly et al. | |
| 2005/0122470 | A1 * | 6/2005 | Perrott et al. | 351/159 |

* cited by examiner

*Primary Examiner* — Sean Shechtman
*Assistant Examiner* — Chad Rapp
(74) *Attorney, Agent, or Firm* — Occhiuti Rohlicek & Tsao LLP

(57) ABSTRACT

A method for blocking an optical lens (10) comprising a moving step in which the optical lens (10) is moved from a first reference position (P1) to a second reference position (P2), so as to be in contact with a blocking material (14), the blocking material (14) being in a molding block (16), the second reference position (P2) being a function of the first reference position (P1), wherein the method further comprises an orienting step in which the optical lens (10) is oriented in the first reference position (P1) and placed on a plurality of pre-located pins (18) which are vertically translated into a preset position ($Z_1$, $Z_2$, $Z_3$), so that, when the optical lens (10) is placed on the plurality of pre-located pins (18), the optical lens (10) is oriented in the first reference position (P1) where the prism of the optical lens (10) corresponds to a desired prism ($\alpha_f$, $\beta_f$, $Z_f$).

13 Claims, 7 Drawing Sheets

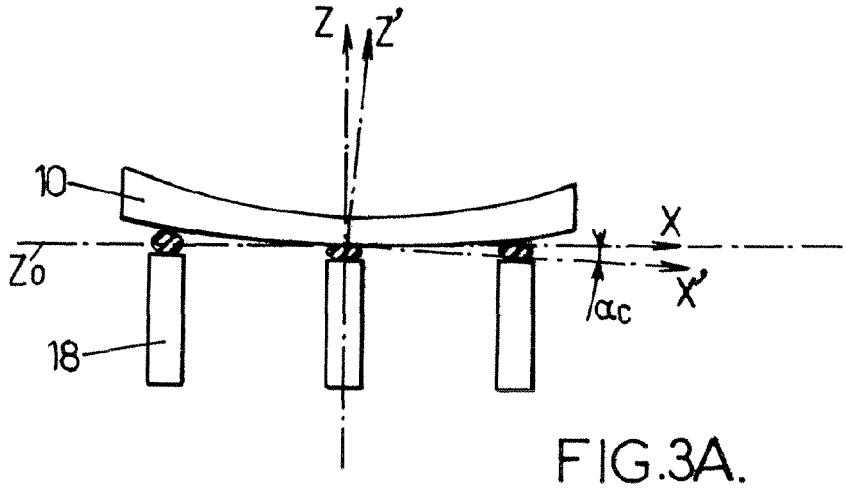
FIG.3A.
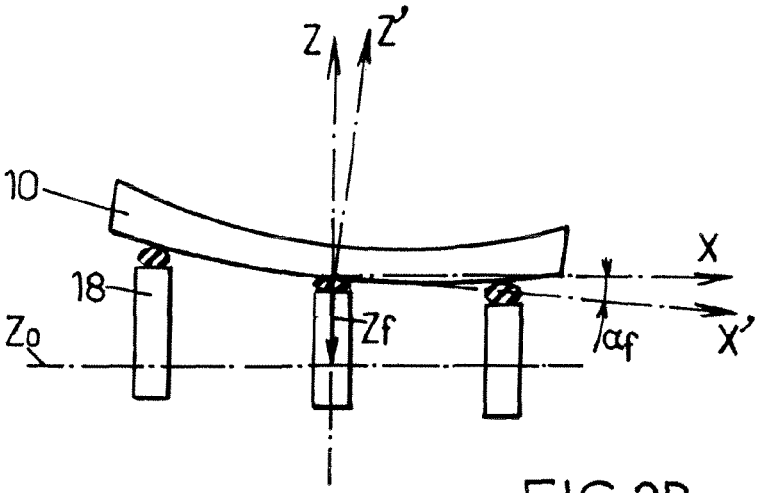
FIG.3B.
FIG.3C.
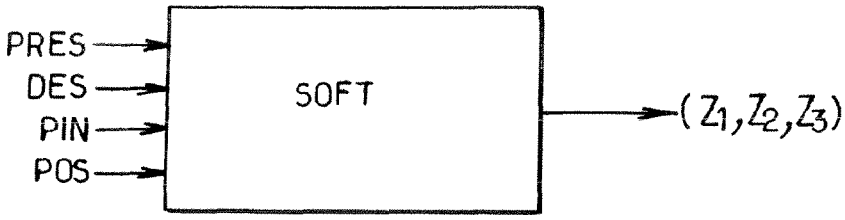

LENS BLOCKING METHOD AND RELATED DEVICE

CROSS-REFERENCE TO RELATED APPLICATIONS

This application is the National Stage of International Application No. PCT/EP2008/059095, filed on Jul. 11, 2008, which claims the priority of European Application No. 07290884.1, filed on Jul. 13, 2007 and European Application No. 07301237.9, filed on Jul. 16, 2007. The content of these applications is hereby incorporated by reference in its entirety.

This invention relates to a method for blocking an optical lens in a reference position on a molding block.

The process of preparing optical or ophthalmic lenses begins with an unfinished or semi-finished glass or plastic optical lens. Typically, semi-finished optical lens has a finished polished front surface and an unfinished back surface. By grinding away material from the back surface of the optical lens, the required corrective prescription is generated. Thereafter, the surface having had the corrective prescription imparted thereto is polished. The peripheral edge of the processed optical lens is then provided with a final desired contour. Thereby establishing a finished optical or ophthalmic lens. The optical lens can be, for example, made of plastic or glass material.

It is necessary during these various processing operations to securely maintain the optical lens in accurate alignment as well as in place on a molding block. This procedure is often referred to as "lens blocking".

During the processing operation a desired prism may be introduced. The desired prism may be either a prescription prism or a non-prescription prism. The manufacturing of such desired prism requires that the lens be oriented in a desired specific orientation with respect to the manufacturing tools. The introduced prism may be different from one lens to another.

U.S. Pat. No. 5,919,080, describes an ophthalmic lens blocker for blocking a lens blank onto a support block. The lens is placed on three non moveable pins and moved trough a measuring device to measure the convex surface of the lens and finally moved to a blocking station to block the lens.

FIG. 1 shows an example of a prior art blocking device wherein an optical lens 10 is disposed above a lens holding unit 12 through a blocking ring 13. A blocking material 14 is provided into the space surrounded by three members, i.e. the optical lens 10, lens holding unit 12 and blocking ring 13. The blocking material is then cooled to solidify so as to block the optical lens 10 by the lens holding unit 12.

Various blocking materials are employed to secure the optical lens to the molding block. These blocking materials include glues, pitch and low temperature fusible metal alloys.

U.S. Pat. No. 6,036,313 discloses examples of compound families suitable for lens blocking with thermoplastic materials In this blocking device, different types of lens holding units 12 and blocking rings 13 are prepared to correspond to the types of the optical lens 10. When blocking an optical lens 10, a lens holding unit 12 and a blocking ring 13 corresponding to the optical lens 10 are selected and used to position the optical lens 10. When the optical lens 10 is blocked by the lens holding unit 12, the center of the optical lens 10 must accurately coincide with the center of the lens holding unit 12.

For this purpose, in the centering devices, the optical lens 10 is clamped and centered with respect to the lens holding unit 12.

Such centering devices require a large number of components, for example a cylindrical member, a ring member, three rollers, three lever members, biasing means, holding portion releasing means, and the like. Accordingly, the structure of such centering devices has the disadvantage of leading to a high manufacturing cost. Such centering devices are thus not practical.

The accuracy of the molding block directly influences the lens machining accuracy, therefore high accuracy for the molding block is required.

Conventionally, the blocking operation is manually performed by the operator. Hence, high accuracy with regard to the molding block cannot be obtained.

When blocking the optical lens 10, the height of the optical surface to be blocked changes depending on the thickness of the peripheral edge of the lens 1.

Thus, a blocking ring 13 matching the thickness of the peripheral edge of the lens 10 is required. As a result, the number of types of the blocking rings 13 increases, and storage and management of the blocking rings 13 are cumbersome.

Conventionally, the optical lens 10 is placed on the blocking ring 13 in advance. A predetermined gap is set between the optical lens 10 and lens holding unit 12. The blocking material 14 is provided into the gap and cooled to solidify.

If the gap at the center is excessively narrow, the blocking material 14 can not reach the center readily, thus causing a dioptric power error.

On the contrary, if the gap is excessively wide, the use amount of blocking material 14 increases inevitably. The influence of heat shrinkage thus increases, and leading to an instability of the lens dioptric power.

The melting temperature and the amount of the blocking material 14 must be controlled highly accurately. Indeed, if the blocking material 14 is deprived of heat by the lens holding unit 12 or the optical lens 10 and is cooled to solidify, it cannot cover the entire surface of the lens holding unit 2. Hence, a sufficient bonding strength can not be obtained.

If the blocking material 14 starts to solidify before its supply operation has not been ended yet, bubbles are generated in the blocking material 14. In this case as well, the blocking material 14 does not cover the entire surface of the lens holding unit 12. Therefore, a sufficient bonding strength can not be obtained.

During the step of supplying the blocking material 14 into the gap between the optical lens and lens holding unit, the operator presses a button to provide the blocking material 14 into the gap. The operator stops supplying the blocking material 14 after he or she visually confirms that the provided blocking material 14 has reached a predetermined amount. This increases burden to the operator. Moreover, the supply amount of blocking material is not stable. However, if the supply amount of blocking material is excessively large, the blocking material 14 overflows from the gap between the optical lens 10 and lens holding unit 12. In this case the blocking material 14 also attaches to the peripheral surface or concave surface of the optical lens 10. If the supply amount is excessively small, sufficient bonding power can not be obtained.

Accordingly, there remains a need for improving blocking an optical lens. Thus, the goal of the present invention is to improve the blocking method of optical lens by providing a method for blocking an optical lens which is more easy to use and which enables to position the optical lens in a more reliable manner so as to ensure a more accurate machining of the lens.

According to an object of the invention a method for blocking an optical lens comprising:

an orienting step in which the optical lens is oriented in a first reference position and placed on a plurality of at least three pre-located pins which are vertically translated into a preset position ($Z_1$, $Z_2$, $Z_3$), so that, when the optical lens is placed on the plurality of at least three pre-located pins, the optical lens is oriented in the first reference position where the vector perpendicular to the tangential plan at the prism reference point (PRP) of the optical lens corresponds to a desired vector ($\alpha_f$, $\beta_f$, $Z_f$), a moving step in which the optical lens is moved from the first reference position to a second reference position, so as to be in contact with a blocking material, the blocking material being in a molding block, the second reference position, being a function of the first reference position.

According to the blocking method of the invention, the optical lens can be blocked in the second reference position which is function of the first reference position. Thus the lens, when being blocked in the second reference position is blocked in a more accurate manner with respect to the manufacturing tools.

In addition and unlike the blocking device disclosed in U.S. Pat. No. 5,919,080, as the pins are moveable in a vertical direction the blocking method according to the invention allows the blocking of the lens in an even more accurate position so as to introduce a desired prism and thereby limiting the modifications of the existing manufacturing tools and/or of the existing manufacturing process. Furthermore, the invention advantageously avoids the change of the entire existing manufacturing tools of a lens manufacturing lab.

According to further embodiments which can be considered alone or in combination:

the method further comprises a calculating step in which a desired vertical position ($Z_1$, $Z_2$, $Z_3$) of the plurality of at least three pins is calculated so that, when the optical lens is placed on the plurality of at least three pins, the optical lens is oriented in a position (P1) where the vector perpendicular to the tangential plan at the prism reference point (PRP) of the optical lens corresponds to a desired vector ($\alpha_f$, $\beta_f$, $Z_f$), the method further comprises a positioning step in which the plurality of at least three pins are translated into the desired vertical position ($Z_1$, $Z_2$, $Z_3$), the second reference position is substantially the same as the first reference position;

after the orienting step the method further comprises a first blocking step in which the optical lens is blocked in the first reference position;

during the first blocking step the optical lens is blocked in the first reference position by a blocking system comprising a plurality of pins;

during the first blocking step the optical lens is blocked in the first reference position by a blocking system comprising a vacuum creating device;

the method further comprises a second blocking step, in which the blocking material reaches a solid state so as to block the optical lens in a second reference position;

before the second blocking step the blocking material is in a intermediate state between a liquid state and a solid state;

the blocking material comprises a material having an intermediate state temperature lower or equal to 54° C.;

the vector perpendicular to the tangential plan at the prism reference point (PRP) of the optical lens in the second reference position is substantially parallel to the vector perpendicular to the tangential plan at the prism reference point (PRP) of the optical lens in the first reference position.

According to another aspect, the invention relates also to a method of machining an optical lens comprising a blocking step in which the optical lens is blocked in a machining position according to a method of the invention and a machining step in which the optical lens is machined.

The machining of the surface may comprise generating a corrective prescription one or both of the surface of the optical lens, for example the sphere and/or the cylinder and/or a progressive additional surface.

The invention relates also to a computer program product for a data processing device, the computer program product comprising a set of instructions which, when loaded into the data processing device, causes the data processing device to perform at least one, for example all, of the steps, for example the calculating step, of the method according to the invention.

In addition, the present invention provides a computer-readable medium carrying one or more set of instructions of a computer program product of the invention.

The invention relates also to a blocking system comprising means to carry out the handling steps of a method according to the invention.

Non limiting embodiments of the invention will now be described with reference to the accompanying drawing wherein:

FIGS. 3A-3D show a schematic view of the orienting step; and

Elements in the figures are illustrated for simplicity and clarity and have not necessarily been drawn to scale. For example, the dimensions of some of the elements in the figure may be exaggerated relative to other elements to help improve the understanding of the embodiments of the present invention.

The wording "upper" indicates a position relative to the optical lens surface when it is arranged so as the molding block 16 is substantially situated in a horizontal plane.

Figure 1:
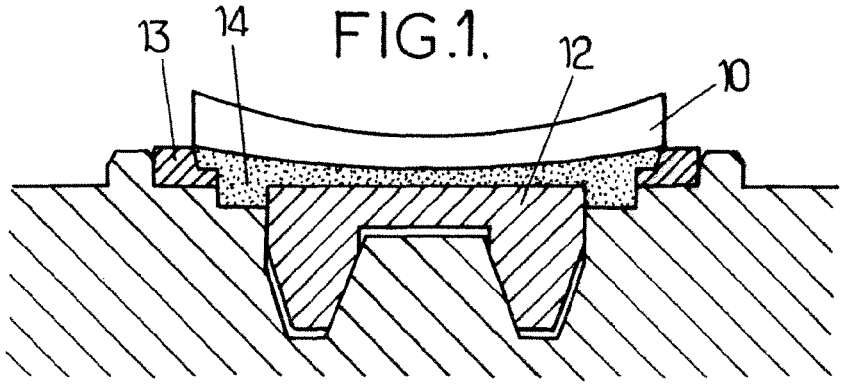
FIG. 1 is a cross sectional view showing a prior art device wherein an optical lens is blocked using a blocking ring.

FIG. 1 has been described in detail when discussing the prior art.

In an embodiment of the invention the blocking method of an optical lens comprises:

a) a orienting step,
b) a first blocking step,
c) a moving step,
d) a providing step,
e) a cooling step,
f) a placing step, and
g) a second blocking step.

The blocking method according to the invention can be used to block in a given position an optical lens. The optical lens can be, for example but not limited to, an ophthalmic lens, in particular an unfinished or semi-finished ophthalmic lens. More generally the optical lens can also be any optical component to be used, for example, in a camera or in a telescope.

It has to be understood that the machining method according to the invention can be used at different stage of the manufacturing process of an optical lens. The machining step can be, for example but not limited to, a cribbing step, a surfacing step, a roughing step, a fining step, a coating or spin coating step, an edging step, a grinding step, a polishing step.

Figure 3D:
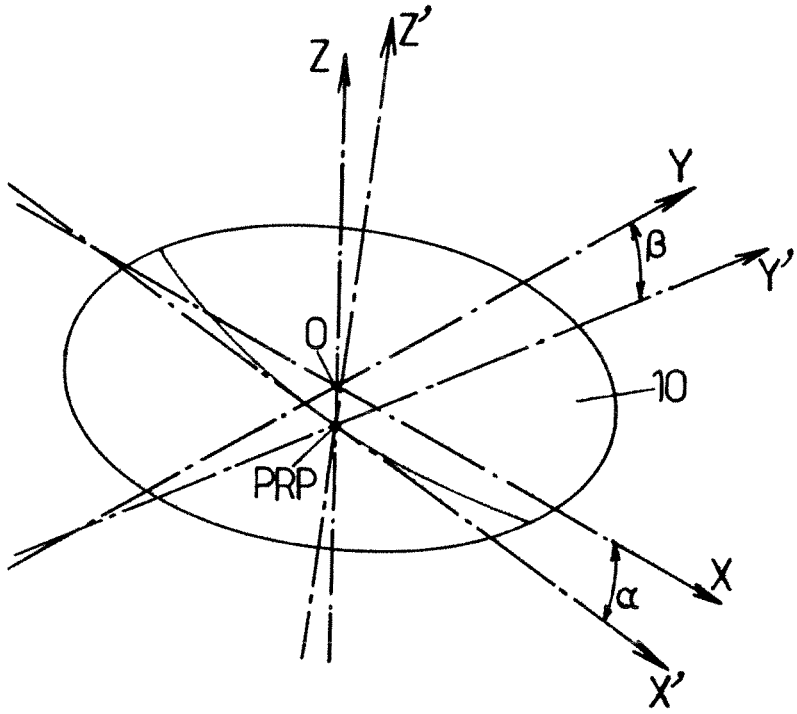

For the purpose of the invention, "the prism" of the optical lens can be defined by the vector ($\alpha_f$, $\beta_f$, $Z_f$) which is perpendicular to the tangential plan at the prism reference point (PRP) of the optical lens; whereby $\alpha_f$ corresponds to the prism amplitude as illustrated on FIG. 3B, $\beta_f$ correspondents to the prism orientation (not shown) and $Z_f$ the vertical position of the PRP.

Figure 2A:
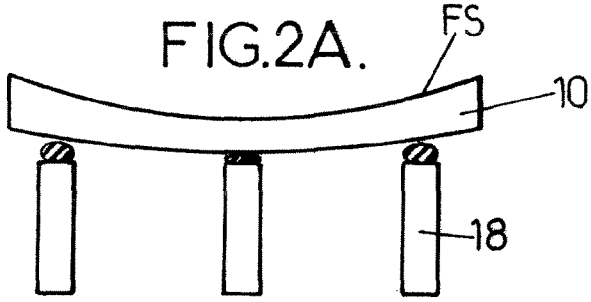
FIGS. 2A-2H show sequential schematic views of the different step of a blocking method according to the invention.

As is illustrated in FIG. 2A, the orienting step a) consists in orienting an optical lens 10 in a first reference position. Prior to the placing operation, the optical lens is oriented in the first reference position and placed on a plurality of pre-located pins 18. The pre-located pins 18 are vertically translated into a preset position so that when the optical lens is placed on the plurality of pre-located pins, the optical lens is oriented in a first reference position where the vector perpendicular to the tangential plan at the prism reference point (PRP) of the optical lens 10 corresponds to a desired vector ($\alpha_f$, $\beta_f$, $Z_f$). As illustrated in FIG. 2A, during the orienting step a), the lens is manually placed by the operator on a plurality, for example three, of pre-located pins 18. For example, the pre-located pins 18 are disposed on the periphery of a 53.5 millimeters diameter circle at 120° from each other.

The pre-located pins 18 can have various geometry. As illustrated in FIG. 3A the pre-located pin 18 can comprise, for example, a cylindrical body that is extended by a spherical surface head.

As illustrated in FIG. 3C, the preset positions $Z_1$, $Z_2$, $Z_3$ of the pins 18 can be, for example, calculated by using a software SOFT having as entry parameter:

- prescription data PRES, such as prismatic value, and/or
- design data DES, describing the geometrical properties of the surface of the lens in particular those of the convex surface of a semi-finished lens, and/or
- pin data PIN, such as the geometry of the pins and the position of the pins, and/or
- positioning data POS, defining the position of the optical lens 10 relatively to the pins 18.

The design data DES according to the invention may be calculated or selected taking into account wearer's parameters such as the wearer's prescription and/or a chosen spectacle frame and/or esthetical criteria and/or morphologic criteria.

The preset positions $Z_1$, $Z_2$, $Z_3$ of the pins 18 are computed such that, when the optical lens 10 is placed on the pins 18 in their preset position $Z_1$, $Z_2$, $Z_3$; the prism of the optical lens 10 correspond to the desired prism ($\alpha_f$, $\beta_f$, $Z_f$).

The software SOFT is thus arranged to first calculate the resulting prism ($\alpha_r$, $\beta_r$, $Z_r$), corresponding to the center of the optical lens 10 when being placed on the pre-located pins 18 and when the center of the spherical surface head of the pre-located pins 18 are aligned on the same horizontal line $Z_0$. The resulting prism ($\alpha_r$, $\beta_r$, $z_r$) can be, for example, calculated by the software SOFT using the design data DES, the pin data PIN and the positioning data POS.

Then the software SOFT is arranged to calculate the desired vertical position ($Z_1$, $Z_2$, $Z_3$) of each of the pins 18 by using the resulting prism ($\alpha_r$, $\beta_r$, $z_r$) and the prescription data PRES.

The desired vertical position ($Z_1$, $Z_2$, $Z_3$) of the pins 18 corresponds to position of each of the pre-located pins 18 so as to have the prism of the optical lens which is equal to the desired prism ($\alpha_r$, $\beta_f$, $Z_f$).

Therefore, as illustrated on FIG. 3B, each of the pins 18 can translated in the thus calculated pre-located positions ($Z_1$, $Z_2$, $Z_3$) so that the optical lens can finally be oriented in order to have the desired prism ($\alpha_f$, $\beta_f$, $Z_f$).

When the pins 18 are in the pre-located position the surface of the optical lens, for example the convex surface can be placed on the pre-located pins 18.

More specifically, the optical lens 10 can be placed on the pre-located pins 18, by adjusting the position of the optical lens 10 such that the periphery of the optical lens 10 image-sensed by a CCD camera coincides with the reference line displayed on the same monitor that displays the optical lens 10, thus securing the positioning accuracy.

Figure 2B:
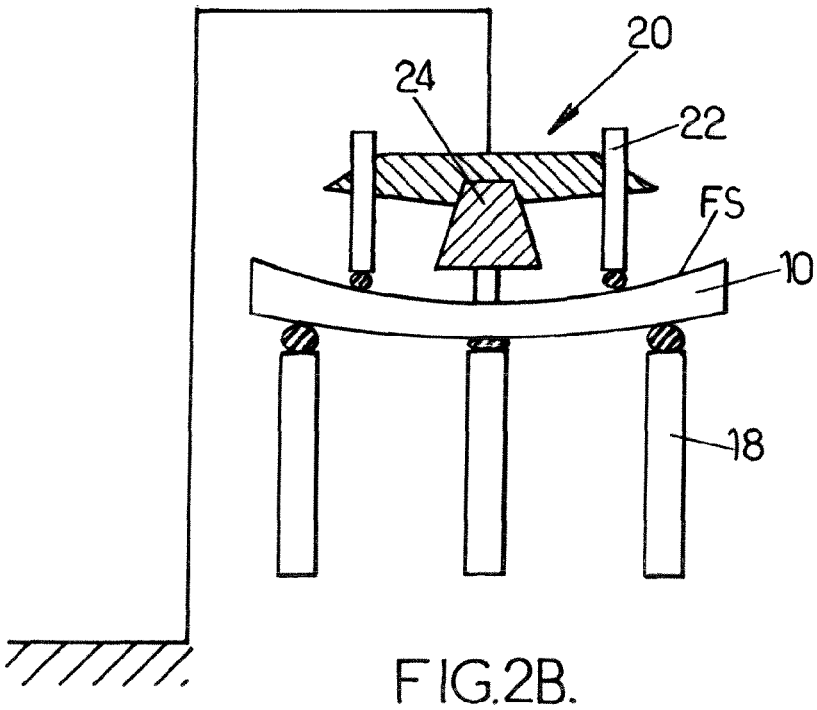
Figure 2C:
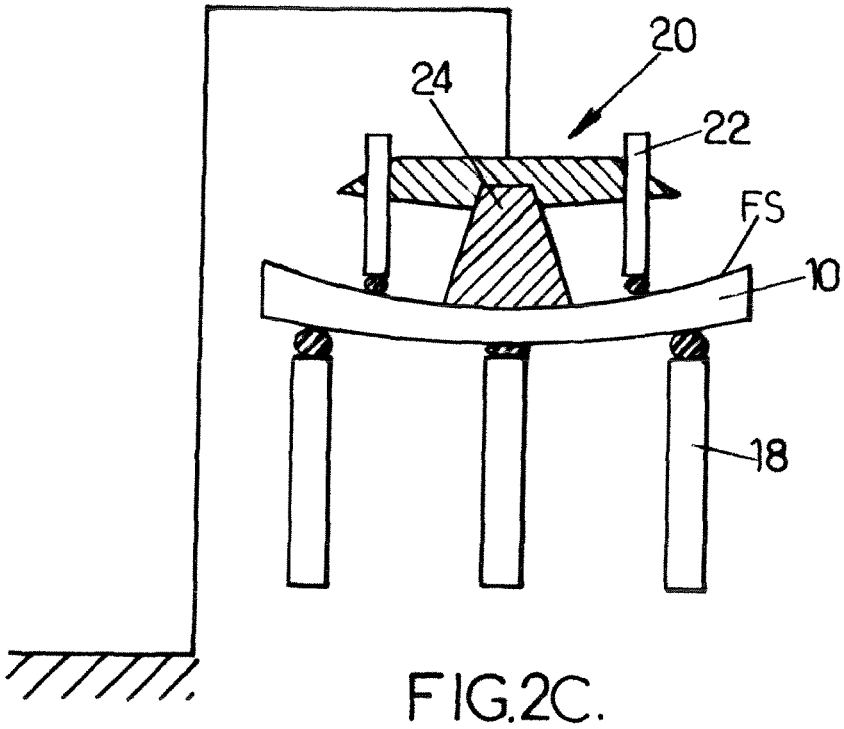

After the orienting step a), the method according to this embodiment further comprises a first blocking step b) illustrated on FIGS. 2B and 2C.

During the first blocking step b), the first reference position ($\alpha_f$, $\beta_f$, $Z_f$), in which the optical lens was placed during the orienting step a), can be measured so as to obtain the first reference position ($\alpha_f$, $\beta_f$, $Z_f$).

The first reference position ($\alpha_f$, $\beta_f$, $Z_f$) of the optical lens 10 can be measured, for example, by using a measuring device 20 comprising a plurality of pins 22.

The pins 22 are put in contact with the free surface FS of the optical lens 10, which is the surface of the optical lens 10 opposite to the one that is in contact with the pre-located pins 18. Once the pins 22 are in contact with the free surface FS of the lens, they are, for example individually, blocked in position by a blocking mechanism (not shown on FIG. 2B) so as to maintain the pins 18 in their exact position.

The blocking mechanism may comprise any reversible blocking means well known from the person skilled in the art.

The first blocking step b) may comprise a contacting step, in which the pins 22 simply come in contact with the free surface FS of the lens in order to hold the optical lens 10 in the first reference position ($\alpha_f$, $\beta_f$, $Z_f$). Additionally, during the first blocking step b), the optical lens 10 is hold and blocked in the first reference position by a blocking system 24, for example a vacuum creating device.

Figure 2D:
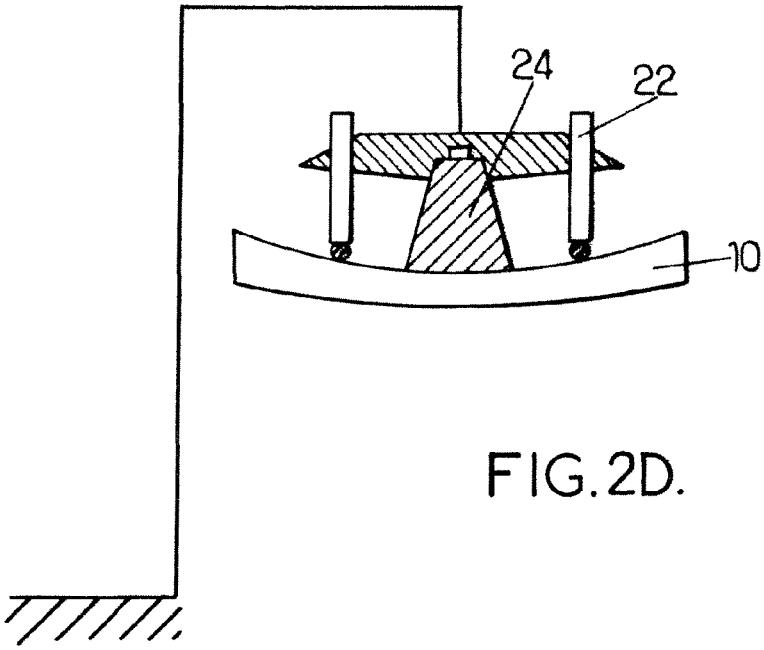

After the first blocking step b) the method according to this embodiment further comprises a moving step c) illustrated on FIG. 2D.

During the moving step, the optical lens 10 is moved from the first reference position P1, ($\alpha_f$, $\beta_f$, $Z_f$) to a second reference position P2, ($\alpha_2$, $\beta_2$, $Z_2$), the second reference position P2, ($\alpha_2$, $\beta_2$, $Z_2$) being a function of the first reference position P1, ($\alpha_f$, $\beta_f$, $Z_f$). For example, the second reference position P2, ($\alpha_2$, $\beta_2$, $Z_2$) is substantially the same as the first reference position P1, ($\alpha_f$, $\beta_f$, $Z_f$).

For the purpose of the invention "the second reference position P2, ($\alpha_2$, $\beta_2$, $Z_2$) is substantially the same as the first reference position P1, ($\alpha_f$, $\beta_f$, $Z_f$)" means that the vector ($\alpha_f$, $\beta_f$) of the optical lens 10 in its first reference position is substantially parallel to the vector ($\alpha_2$, $\beta_2$) of the optical lens 10 in its second reference position. In a particular embodiment of the invention, additionally, the vertical position $Z_f$ of the PRP of the optical lens 10 in its first reference position is substantially the same as the vertical position $Z_2$ of the PRP of the optical lens 10 in its second reference position.

The optical lens 10 is moved from its first reference position on the pre-located pins 18 to a position which allows putting the lens in contact with a blocking material 14.

Figure 2E:
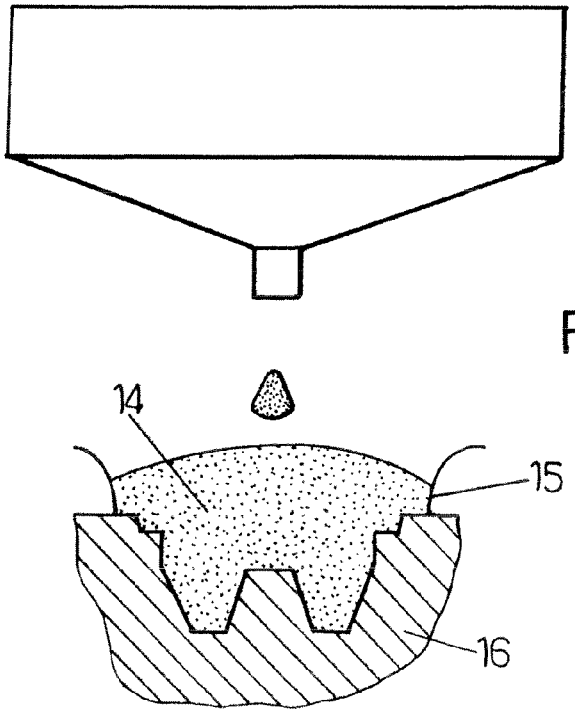
Figure 2F:
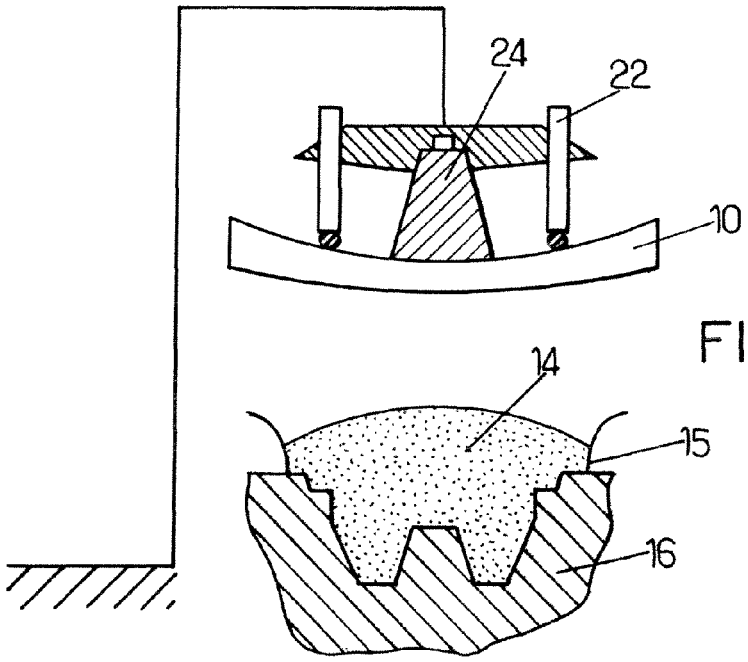

During steps a) to c), the method according to the present embodiment, for example, comprises a providing step d) illustrated on FIG. 2E, in which an adapted amount of a blocking material 14 is poured provided to a molding block 16.

In an alternative embodiment, before pouring the blocking material 14 in to the molding block 16 a holding unit 12 can be inserted in the molding block 16.

As illustrated on FIG. 2E, in another embodiment, a blocking ring 15 may be provided at the surface of the molding block 16.

The blocking material 14 may include glues, pitch, low temperature fusible metal alloys and for example thermoplastic materials as disclosed in U.S. Pat. No. 6,036,313.

According to the present invention, a "thermoplastic material" is a material which comprises at least a thermoplastic material.

The thermoplastic materials have many advantages over traditional metal alloy materials. For example, the blocking materials 14 are non-toxic, environmentally safe, and for example biodegradable. The thermoplastic materials can be used with existing processing equipment and may be recycled. A molding block 16 comprising a solidified mass of a blocking material 14 can be used. The blocking material 14 may comprise a homopolymer or copolymer of epsilon-caprolactone, and for example has a number average molecular weight of at least 3,000, a mean bending modulus of at least 69 MPa at 21° C., or a mean flexural strength of at least 1 MPa at 21° C. The composition is solid at 21° C. and has a sufficiently low melting or softening point such that the composition may be placed adjacent to an ophthalmic lens blank at its melting or softening point without damaging the lens blank. The composition also has sufficient adhesion to an optical lens 10 or to an optical lens coating or tape to hold the optical lens 10 during a machining procedure.

The blocking material 14 is provided at a first state temperature, the first state temperature being for example above its melting or softening temperature, for example it is a temperature at which at least part of the blocking material 14 will flow under moderate pressure.

The blocking material 14 may be poured in the molding block 16 as illustrated on FIG. 2E or injected into the molding block 16 under moderate pressure. Advantageously, pouring the blocking material allows to limit to one the numbers of melting pots, and the pouring conditions can be kept constant above the melting temperature of the blocking material 14.

For example, the amount of blocking material 14 in its intermediate state is measured to be adapted to the optical lens 10. In the sense of the invention "adapted to the optical lens" shall mean that the amount of blocking material 14 provided in the molding block 16, in its intermediate state, is calculated so that the volume defined by the internal surface of the molding block 16 and the surface of the optical lens 10 and taking into account is substantially equal to the volume of the blocking material 14 in its solid state. Of course if in an alternative embodiment holding unit 12 is inserted in the molding block 16 the geometry of the holding unit 12 should be taken into account for measuring the adapted amount of blocking material to be poured.

Advantageously, after the previous providing step d), the method according to the present embodiment further comprises a cooling step e), in which the blocking material 14 cools from its first state temperature to an intermediate state temperature, for example the intermediate state temperature being noticeably equal to the melting or softening temperature of the blocking material.

The cooling of the blocking material may be active, for example using water cooling, or passive, for example heat exchange with ambient air.

Thus, the cooling step e) avoids the thermal shock due to the contact between the optical lens 10 and the blocking material 14 when the temperature of the blocking material is too high. For example, the intermediate state temperature is below 54° C., or below 53° C.

For example, the blocking material is chosen in order to have its molding temperature below 54° C., or below 53° C.

Figure 2G:
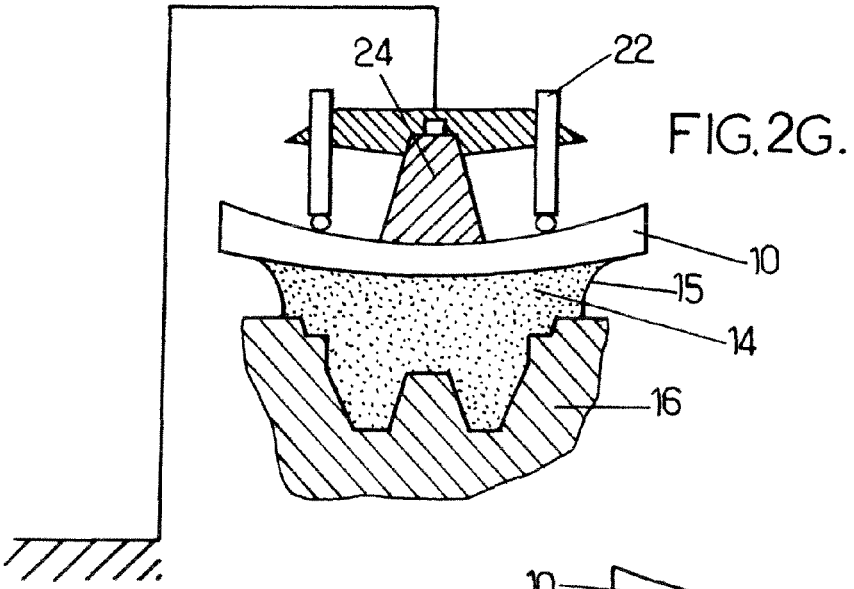

After the cooling step e), when the blocking material 14 is in the intermediate state, the method according to the present embodiment comprises a placing step f) in which a surface of the optical lens 10, for example the convex surface, in the first reference position is placed in contact with the blocking material 14 as illustrated on FIG. 2G. Advantageously, the speed at which the optical lens is placed in contact with the blocking material 14 can be adjusted so as to reduce the creation of air bubbles inside the blocking material 14.

The blocking material is then cooled to a blocking state temperature. The final state temperature being close to room temperature, for example around 21° C.

The final state temperature is chosen so that the blocking material is solid at such temperature.

Figure 2H:
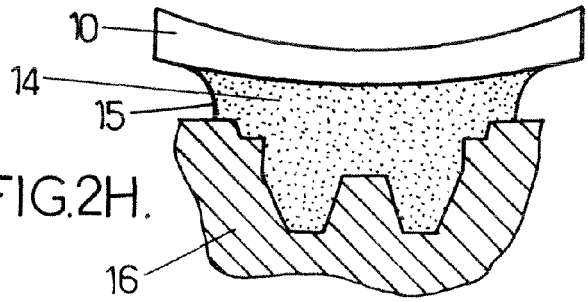

After, the placing step f), the method according to the present embodiment comprises a second blocking step g) in which the optical lens is blocked in its second reference position, as illustrated on FIG. 2H.

After the second blocking step g), the blocking system 24 releases the optical lens.

Thus, the optical lens 10 can be blocked in its second reference position and its free surface FS, can be machined.

In the above-mentioned description, the first reference position P1 and the second reference position P2 were defined with respect to the vector ($\alpha$, $\beta$, Z) which is perpendicular to the tangential plan at the prism reference point (PRP). It has to be understood, that other point of the optical lens, different from the prism reference point (PRP), can also be used as reference point in order to define the first reference position P1 and the second reference position P2 of the optical lens.

The invention also relates to a blocking system comprising means to carry out the handling steps of a method according to the invention.

An example of such a blocking system as illustrated on FIG. 3 comprises a carousel 25 comprising four machining stations A, B, C, D.

The first machining station A comprises an incoming conveyor 34, convoying the empty molding blocks 16, and a first handling device 26. The first handling device 26, moves the empty molding blocks 16 from the incoming conveyor 34 onto the carousel 25.

The carousel 25 may have a clockwise rotating movement, therefore moving the empty molding block 16 to the second machining station B.

The second machining station B comprises a providing device 32, so as to provide the adapted amount of blocking material 14 in the molding block 16.

The providing device 32 can be a poring device 32 arranged to pour the adapted amount of blocking material 14, at a temperature above its melting temperature, into the molding block 16.

The second machining station B can carry out the providing step d) of the blocking method as described previously.

The molding block 16 with the adapted amount of blocking material 14, is moved by the carousel 25 to the third machining station C.

Figure 4:
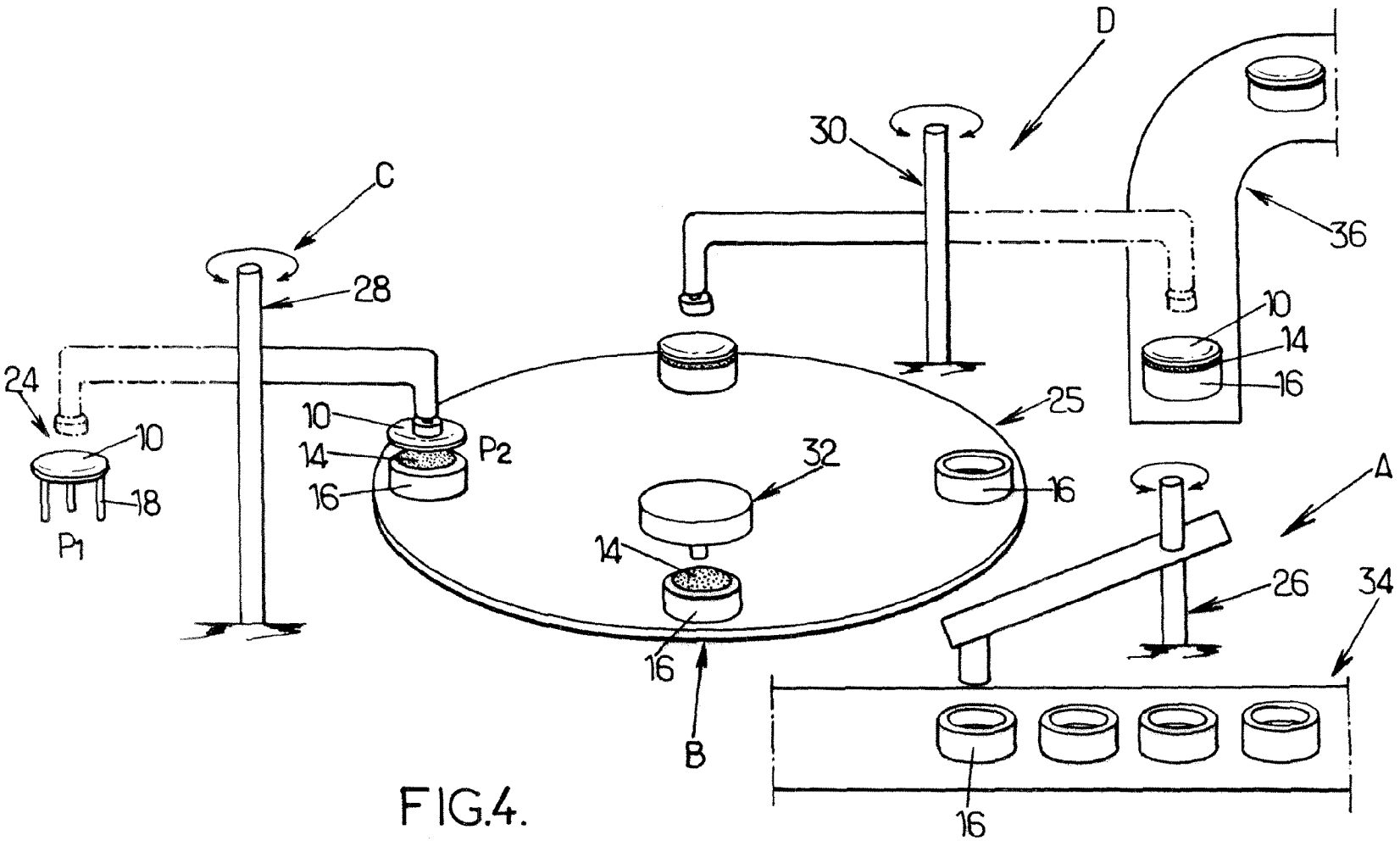
FIG. 4 is a schematic view of a blocking system according to the invention.

A blocking system according to the invention may comprise means for cooling the blocking material 14 (not shown on FIG. 4), such as water cooling means. Such cooling device may carry out the cooling step e) of the blocking method as described previously.

The third machining station C comprises orienting means 18 and a second handling device 28.

The orienting means 18 comprises pre-located pins 18 so as to orient the optical lens 10 according to the orienting step a) of the blocking method as described previously.

The second handling device 28 comprises a blocking system 24 so as to move the lens 10 from a first reference position (P1) to a second reference position (P2), so as to be in contact with a blocking material 14, the blocking material being in a molding block 16, the second reference position (P1) being a function of the first reference position (P2).

The second handling device 28 may also carry out the first blocking b), the moving c), the placing f) and the second blocking g) steps of the blocking method as described previously.

The fourth machining station D comprises an outgoing conveyor 36, convoying the molding blocks 16 with the optical lens 10 blocked in its second reference position, and a third handling device 30. The third handling device 30, moves the molding block 16 from the carousel 25 on to the outgoing conveyor 36. Each of the steps comprised in the method according to the previous embodiments can be carried out by a computer program comprising one or more stored sequence of instruction that is accessible to a processor and which, when executed by the processor, causes the processor to carry out each of the steps of the method.

The invention has been described above with the aid of an embodiment without limitation of the general inventive concept.

In particular the present invention provides for a method for blocking all kinds of lenses and substrates, particularly ophthalmic lenses, e.g. single vision (spherical, torical), bifocal, progressive, aspherical, etc. and semi-finished lenses.

The invention claimed is:

1. A method for blocking an optical lens comprising:

an orienting step in which the optical lens is oriented in a first reference position (P1) and placed on a plurality of at least three pre-located pins which are vertically translated into a preset position ($Z_1$, $Z_2$, $Z_3$), so that, when the optical lens is placed on the plurality of at least three pre-located pins, the optical lens is oriented in the first reference position (P1) where the vector perpendicular to the tangential plan at the prism reference point (PRP) of the optical lens corresponds to a desired vector ($\alpha_f$, $\beta_f$, $Z_f$), a moving step in which the optical lens is moved from the first reference position (P1) to a second reference position (P2), so as to be in contact with a blocking material, the blocking material being in a molding block, the second reference position (P2), being a function of the first reference position (P1).

2. The method according to claim 1, further comprising prior to the orienting step:

a calculating step in which a desired vertical position ($Z_1$, $Z_2$, $Z_3$) of the plurality of at least three pins is calculated so that, when the optical lens is placed on the plurality of at least three pins, the optical lens is oriented in a position (P1) where the vector perpendicular to the tangential plan at the prism reference point (PRP) of the optical lens corresponds to a desired vector ($\alpha_f$, $\beta_f$, $Z_f$), a positioning step in which the plurality of at least three pins are translated into the desired vertical position ($Z_1$, $Z_2$, $Z_3$).

3. The method according to claim 2, wherein during the calculating step the desired vertical position ($Z_1$, $Z_2$, $Z_3$) of the plurality of at least three pins is calculated according to at least the geometrical parameters of a surface of the lens and the geometrical parameters of the pins.

4. A non-transitory computer-readable medium comprising a program product for a data processing device, the computer program product comprising a set of instructions which, when loaded into the data processing device, causes the data processing device to perform, the method according to claim 2.

5. The method according to claim 1 wherein after the orienting step the method further comprises a first blocking step, in which the optical lens is blocked in the first reference position.

6. The method according to claim 5, wherein during the first blocking step the optical lens is blocked in the first reference position by a blocking system comprising a plurality of pins.

7. The method according to claim 5, wherein during the first blocking step the optical lens is blocked in the first reference position by a blocking system comprising a vacuum creating device.

8. The method according to claim 1 wherein the method further comprises a second blocking step, in which the blocking material reaches a solid state so as to block the optical lens in a second reference position.

9. The method according to claim 8 wherein before the second blocking step the blocking material is in an intermediate state between a liquid state and a solid state.

10. The method according to claim 9, wherein the blocking material comprises a material having an intermediate state temperature lower or equal to 54° C.

11. The method according to claim 1, wherein vector perpendicular to the tangential plan at the prism reference point (PRP) of the optical lens 5 in the second reference position (P2) is substantially parallel to the vector perpendicular to the tangential plan at the prism reference point (PRP) of the optical lens 5 in the first reference position (P1).

12. A method of machining an optical lens comprising:

a blocking step, in which the optical lens is blocked in a machining position according to the method of claim 1; and a machining step, in which the optical lens is machined.

13. A non-transitory computer-readable medium comprising a program product for a data processing device, the computer program product comprising a set of instructions which, when loaded into the data processing device, causes the data processing device to perform the steps of the method claim 1.

* * * * *